United States Patent [19]

Sutton et al.

[11] Patent Number: 4,741,539

[45] Date of Patent: May 3, 1988

[54] BOARD GAME RELATING TO PERSONALITY TRAITS

[75] Inventors: John A. Sutton, 6 Pump Hill, Loughton, Essex; Philip E. Sawyer, London, both of England

[73] Assignee: John A. Sutton, Loughton, England

[21] Appl. No.: 718,445

[22] Filed: Apr. 1, 1985

[51] Int. Cl.[4] ..... A63F 3/00

[52] U.S. Cl. ..... 273/275

[58] Field of Search ..... 273/243, 248, 249, 275

[56] References Cited

U.S. PATENT DOCUMENTS

| | | | |
|---|---|---|---|
| 1,240,756 | 9/1917 | Moore | 273/243 |
| 3,815,919 | 6/1974 | Cain et al. | 273/249 |
| 4,004,810 | 1/1977 | Henrie | 273/249 |
| 4,046,381 | 9/1977 | Comeaux | 273/249 |
| 4,190,256 | 2/1980 | Rudden | 273/275 |

*Primary Examiner*—Anton O. Oechsle

*Attorney, Agent, or Firm*—Holman & Stern

[57] ABSTRACT

A board game comprising a playing board of general hexagonal configuration, the playing area being divided into six triangular areas each representing a trait of the personality and each triangular area being divided into contiguous hexagonal areas; at least one set of cards printed with questions to be answered by the players to determine their progress during the game and a plurality of tokens for placing on the board to indicate the position and/or progress of a player during the game.

1 Claim, 2 Drawing Sheets

Figure 1:
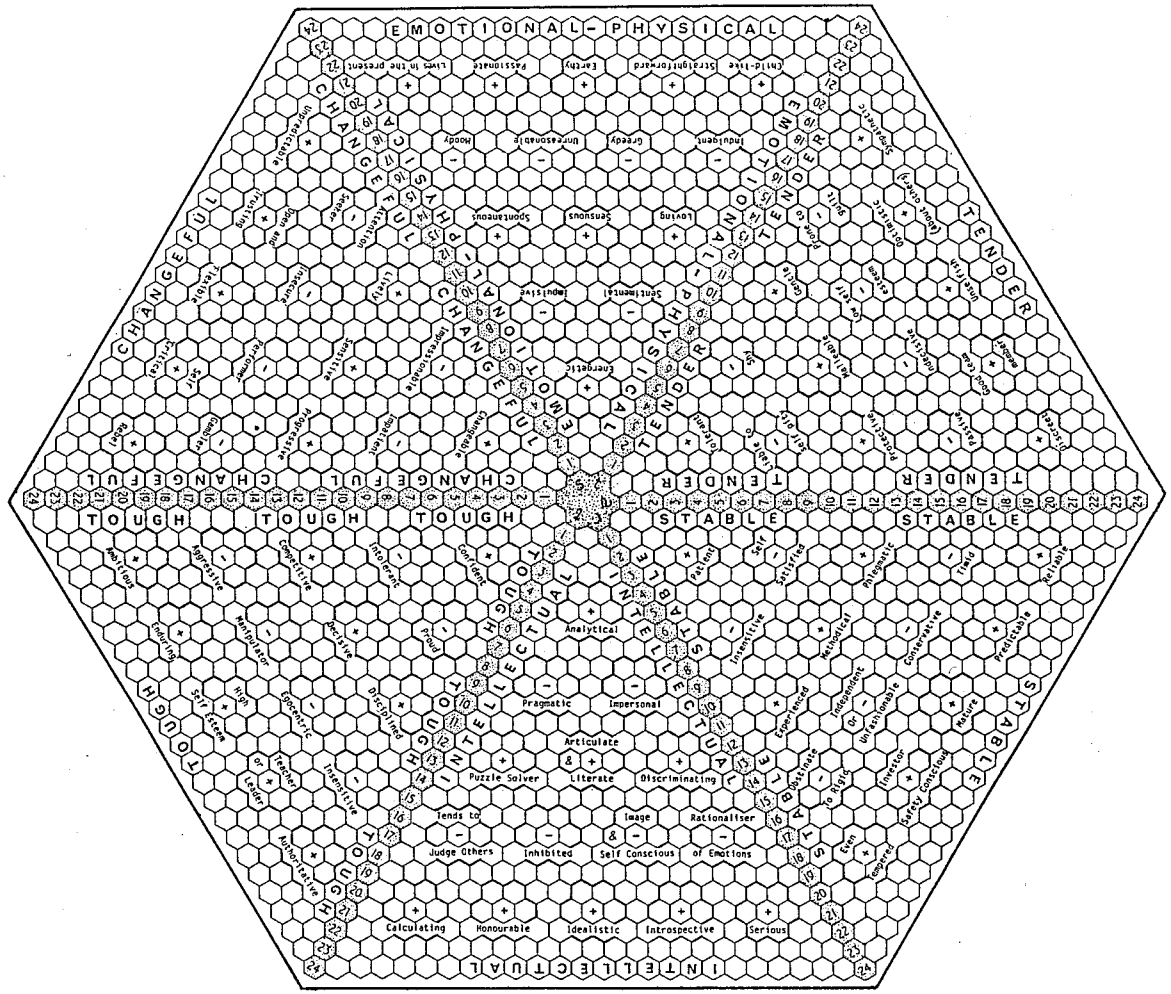

EMOTIONAL-PHYSICAL
INTELLECTUAL
TENDER
STABLE
TENDER
STABLE
TENDER
STABLE
CHANGEFUL
TOUGH
CHANGEFUL
TOUGH
CHANGEFUL
TOUGH
CHANGEFUL
TOUGH
CHANGEFUL
TOUGH

Q xxx

Does the first statement below apply to you more than the second?

1. I tend to suffer in silence.
2. I know where to find a shoulder to cry on.

FIG. 2

BOARD GAME RELATING TO PERSONALITY TRAITS

The present invention relates to a board game concerned with the personality, persuasion and mood of the players.

The board game of the invention requires players to choose a position on the board representing their own and other players' personality. Then during play the accuracy of those predictions is tested, the player with the most accurate predictions being the winner.

In accordance with the invention a board game comprises (1) a playing board of general hexagonal configuration, the playing area being divided by three main axes into six triangular areas each representing a trait of the personality and each triangular area being divided into contiguous hexagonal areas; (2) at least one set of cards printed with questions to be answered by the players to determine their progress during the game; and (3) a plurality of tokens for placing on the board to indicate the position and/or progress of a player during the game.

During play of the game each player takes a card in rotation. Points are awarded in response to the answer given to the question on the card and the player places a number of progress tokens on the board in a line or lines which lead towards the edge of the board and the object of the game is for a player to produce a line of progress tokens leading from the centre of the board to a point on the edge of the board which he has previously predicted as being representative of the personality in which he has chosen to play the game.

FIG. 1 of the drawings shows one form of board for use in playing the game; and

FIG. 2 shows an example of a card for playing the game.

As seen from FIG. 1 the board is hexagonal overall and the playing area itself consists of many smaller hexagons, herein called "hexons". In the preferred form of the game the board has almost 2000 hexons. These are divided into 6 triangular zones which have their apices towards the centre of the board and their bases towards the edge. Each triangle represents a major area or trait of personality. They are arranged so that opposing traits, occupy the opposite sides of the board. In the preferred version of the game the opposing traits are: Tough and Tender; Stable and Changeful; and Emotional/Physical and Intellectual. Thus there are 3 main axes within the board along which the players move their progress tokens during the game. Because the playing area consists of hexons all three of these axes are accessible from any position on the board during the game.

Different sizes of board are envisaged for different versions of the game. For example, smaller sizes of board are appropriate for travelling or portable games or in versions for players of younger age groups. However, the currently preferred version has 24 hexons in each side of the 6 trait triangles.

In the preferred version of the board each of the six major trait zones is sub-divided into fifteen smaller areas each of seven hexons. Since these smaller areas resemble flowers they are herein referred to as "florets". Each is labelled with a descriptive word for a sub-characteristic of the major trait, e.g. "idealistic" in the Intellectual trait zone or "sensuous" in the Emotional/-

Physical trait zone, so that the overall character of the trait is described by the fifteen words.

In the preferred form of the game players are each given two predictor tokens for their own personality. Depending upon the level of competence of the players or according to their choice they may also use none, one or two predictor tokens when trying to predict the final position of the other players. Predictor tokens are placed along the edge of the board at the point along the bases of the personality trait triangles which the players think the progress tokens concerned will finish the game. Thus, for example, a player intending to play a very competitive role in the game would put a token down in the Tough triangle edge. He might choose the Intellectual side of the Tough triangle if he thought that answers showing an analytical and calculating tendency would be the way to achieve this prediction. Another player who wanted to see what it was like to play in an Emotional persona, for example, might choose the opposite side of the board. He might choose the Tender side of the Emotional/Physical edge but during the game his answers lead him more towards the Changeful side of this trait triangle unless he knows the game extremely well or is fortunate to receive enough questions which make Tender points available to him. Thus the initial choice of position is a skilled process because the 6 trait areas blend into one another in terms of the play despite the fact that they remain spatially discrete on the board.

The process of trying to work out the value of the questions before answering is also skilfull. There is an element of chance in the questions that each player receives that influences the rate and direction of progress tokens. Players find themselves wanting to work out the answers before committing themselves to counteract this element of chance because, unless players specifically agree not to do so at the beginning, there is nothing to stop players lying in order to win the points they want.

Points are awarded to answers which are usually a simple "Yes" or "No". For example, the question "Do you like driving, or being driven, fast?", awards Emotional/Physical points to the answer "Yes". The exact number depends upon the version of the game being played but in the preferred version it would be three points to reflect the physical nature of the enjoyment of speed. This is derived from "Sensuous" "lives-in-present" and "energetic" florets within the Emotional/-Physical zone. This answer also wins Changeful points of which there are also three in the preferred version because of the willingness to take the risks that driving fast involves (derived from, for example, florets labelled "gambler", "performer" and "lively"). Tough points could also be awarded, derived from florets labelled "confident", "high self-esteem" and "competitive" or "agressive". In this example the player could place either 6 hexons along a single progress line or 3 hexons on each of two progress lines. The answer "No" to this particular question gains points in the Stable sector of the board.

Some questions award points to a "Yes" or a "No" answer but not to both. For example, the question "Are you good at technical things like cameras or Hi-Fi equipment?", gives Intellectual points to the answer "Yes" but none to the answer "No" because the absence of a technical interest does not of itself mean that the player has the opposite trait. In the preferred form of the game the recipient of a question who wins no points for an answer is given another question so that players are assured of moving on the board at each turn.

Another form of question involves a choice between two statements. The choice might be whether one of the statements is more valid than the other or perhaps more applicable to the player who is answering, for example. Such a question is shown on the card in FIG. 2. If the player replies "Yes", meaning that he tends to suffer in silence more than he knows where to find a shoulder to cry on, he would be awarded Intellectual and Stable points because he is admitting that he tends to subdue subjective feelings and emotions and, moreover, this is behaviour which is unlikely to cause the player to change. The answer "No" indicates someone who firstly does not object to exposing their feelings and thereby earns Emotional/Physical points, and secondly is prepared to react with other people in which case there is an implied willingness to learn from others, a Changeful characteristic.

A third kind of question involves the answer being evaluated by other players. An example of this might be: "What is your favorite song?". According to the answer the other players will award points as they see fit, the number of points at stake being indicated on a separate list or set of cards. In this way an interaction occurs which is unique to the game. Some of these questions even lend themselves to another stage of interaction where the player who nominates a song, for example, might himself have several points to award for the way in which his choice of song was assessed.

There is therefore a wide variety of questions and there should be a considerable number of them. It is envisaged that several series of questions will be made available to sustain this variety. This makes is difficult for players to remember the values of many answers, which prevents lying from becoming routine. In any case players often want different points from the same question in different games and this confuses them and tends to make them forget the value of the answer. As a further check on lying a rule may be included by which players select the questions to be put to their opponents. This causes those questions which have an obvious value to the answer for the two players concerned to be excluded.

As indicated above, progress tokens are laid on the board in lines which lead from the centre of the board to the edges thereof, the hexons defining spaces in which the progress tokens are laid. Thus, for example, the award of three Intellectual points allows the player who wins them to add 3 tokens to either of his 2 token lines in the direction of the Intellectual edge of the board. Each progress token line must work its way towards a predictor token to win the game. The tracks left display the character played by each player as well as his rate of progress towards his objectives.

Florets may serve other functions than merely describing a trait. Thus, for example, some florets are marked +and others −, since each trait has both advantageous and disadvantageous characteristics. These are used in the game to give players who land on them bonuses or forfeits. Bonuses awarded to a player who lands on a floret marked "+" need not be claimed immediately and can be used to offset a forfeit due when a player lands on a floret marked "−". This reflects real life situations when the disadvantages of a trait require to be offset by its advantages to produce a satisfactory personality.

In other versions of the game abstract words such as "Shy" will be replaced with well known characters in literature or history for example. Thus "Scrooge" could be a character's name on a negative floret in the Tough zone. The name "Einstein" would apply, for example, to a floret in the Intellectual triangle. Also, trait names could be simplified for the benefit of younger players, so that Intellectual might become "Head" and Emotional/Physical "Heart", Changeful might change to "Growing", etc. A further alternative in the game for young players is to label the floret with animals and so describe the trait by a collection of animals. Thus, a lion would be in the Tough segment, a mouse in the Tender segment and an elephant in the Intellectual segment, etc.

In the preferred form of the game there are two ways in which the game ends. Progress tokens are required to stop on the hexon upon which they land for the rest of the game when the hexon is in the outermost rank of hexons. When both progress token lines for one player reach the outermost rank of hexons, the game ends for all players, not just for the player whose second token has reached the outermost rank. The object of the game is therefore to be the player who reaches the edge first as near to the predictor tokens as possible, catching the others in positions further away from the predictions that they have made. However, timing this manoeuvre is difficult which tends to make players put it off. Also the questions provoke considerable discussion, for this is what they are designed to do, and this reduces the number of moves made so that the alternative of ending the game at an agreed time may be necessary, when the accuracy of the predictions may again be compared in order to determine the winner of the game.

What is claimed is:

1. A board game comprising: a playing board having a generally hexagonal configuration including a playing area separated into six regions by three main axes, each said region having a triangular area, each said region having indicia representing a trait of a personality and each said region including a plurality of contiguous hexagonal areas; at least one set of cards printed with questions to be answered by the players to determine their progress during the game;

said three main axes having a common intersection;

opposed pairs of said six regions of said playing board representing opposing personality traits;

each of said six regions having a plurality of sub-areas comprising groups of contiguous hexagonal areas which have indicia representing characteristics subordinate to the personality trait represented by respective said regions and which together comprise a description of the personality represented by each said region;

a first set of tokens for predicting a final position of a player, for placement along an edge of said playing area adjacent a location representing a final predicted board position;

answers to questions posed by ones of said of cards being awarded points based upon the personality trait indicated;

a second set of tokens for indicating progress of a player during a game; said second set of tokens respectively providing a device by which the accuracy of the prediction is tested by comparing its position and progress on the board with that of the predictor token;

the nature and value of the answers to said questions posed by said cards testing the accuracy of the players predictions of the personalities involved, manifested as the sum of the individual values of the answers provided by each player during the game which are listed on a chart provided, the individual values demonstrating numerically the relationship between the player's response to each question and said main axes on the board.

* * * * *